US006612121B2

(12) United States Patent
Moon et al.

(10) Patent No.: US 6,612,121 B2
(45) Date of Patent: Sep. 2, 2003

(54) AIR CONDITIONER CONTROL SYSTEM AND CONTROL METHOD THEREOF

(75) Inventors: Joong-Ki Moon, Seoul (KR); Young-Man Kim, Seoul (KR); Jae-Myoung Moon, Suwon (KR); Jung-Min Lee, Suwon (KR); Jong-Youb Kim, Suwon (KR); Il-Yong Cho, Seoul (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 10/019,531

(22) PCT Filed: Jan. 5, 2001

(86) PCT No.: PCT/KR01/00020

§ 371 (c)(1),
(2), (4) Date: Jan. 3, 2002

(87) PCT Pub. No.: WO01/94856

PCT Pub. Date: Dec. 13, 2001

(65) Prior Publication Data

US 2003/0101739 A1 Jun. 5, 2003

(51) Int. Cl.[7] ..... F25B 7/00; F25B 1/00
(52) U.S. Cl. ..... 62/175; 62/228.4
(58) Field of Search ..... 62/228.4, 175, 62/197, 199, 509; 236/1 B

(56) References Cited

U.S. PATENT DOCUMENTS 4,122,688 A * 10/1978 Mochizuki et al. ..... 62/196 R
5,077,982 A * 1/1992 Shaffer, Jr. ..... 62/199
5,247,989 A * 9/1993 Benevelli ..... 165/30
6,047,557 A * 4/2000 Pham et al. ..... 62/228.5
6,408,635 B1 * 6/2002 Pham et al. ..... 62/222

FOREIGN PATENT DOCUMENTS

KR 96-6363 B 5/1996
KR 99-215158 B 5/1999

* cited by examiner

*Primary Examiner*—Denise L. Esquivel
*Assistant Examiner*—Marc Norman
(74) *Attorney, Agent, or Firm*—Staas & Halsey LLP

(57) ABSTRACT

An air conditioner control system comprises an outdoor unit having a compressor controlled by pulse-width modulation, and a plurality of indoor units. Each of the plurality indoor units has an indoor control unit to calculate a respective required individual cooling capacity, and an indoor communication circuit unit through which the required individual cooling capacity calculated is transmitted. The outdoor unit has an outdoor control unit producing a duty cycle control signal in response to the required individual cooling capacity transmitted from the indoor units to control the capacity of the compressor, and an outdoor communication circuit unit to communicate the indoor communication circuit unit of respective ones of the plurality of indoor units. Each of the plurality of indoor units calculates the required individual cooling capacity based on at least one of an available cooling capacity of the respective one of the plurality of indoor units itself and the difference between a detected indoor air temperature and a preset temperature.

58 Claims, 8 Drawing Sheets

AIR CONDITIONER CONTROL SYSTEM AND CONTROL METHOD THEREOF

TECHNICAL FIELD

The present invention relates to an air conditioner. More particularly, it relates to an air conditioner control system and control method thereof employing a pulse-width modulated compressor.

BACKGROUND ART

An air conditioner provides conditioned air by controlling the properties air such as room temperature and humidity of houses and buildings by means of a refrigeration cycle. Since people living and working in these houses and buildings differ from each other in their desired indoor conditions, and since the outdoor environment varies, the required cooling capacity may change frequently. In a multi-air unit conditioner having a plurality of indoor cooling units connected to a single outdoor unit, the respective indoor units differ from each other in the required cooling capacity. In most cases, since the respective indoor units may operate independently of one another, the total cooling capacity obtained by summing up the cooling capacity required from all the indoor units, tends to vary widely and unpredictably. A variable revolution compressor has been disclosed as a compressor that can vary its capacity in response to a variable cooling demand. In such a variable revolution compressor, the capacity of the compressor is regulated for a variation in required cooling capacity in such a way that the revolution of a motor is controlled by varying the frequency of current applied to the motor. However, the conventional variable revolution compressor is problematic in that the revolution of its motor cannot be controlled with a desirable responsiveness and accuracy because the operating motor has to be controlled directly according to a required cooling capacity. Additionally, since the revolution of the motor is frequently varied, vibrations and noises occur, shortening the life span of the motor and the compressor, and thus compromising the mechanical reliability of the entire system.

In addition, since an expensive and complicated circuit device and excessive power consumption are required in order to vary the frequency of the current applied to the motor, the conventional variable revolution compressor is less cost/energy efficient than a general compressor. Particularly, a conventional variable revolution compressor requires several power conversions, e.g., initially inputted commercial AC power into DC power, and the DC power into AC power having a required frequency, through converters, resulting in the structure of the circuit device being complicated and noises being generated frequently in the converter circuit devices.

In addition, a large-capacity variable revolution compressor is, particularly, problematic in that it is difficult to control the compressor, due to its low efficiency, large size and the high cost, so it is difficult to fulfill large-capacity requirements with a variable revolution compressor. Accordingly, in order to fulfill a large capacity requirement two or more compressors are employed. In this case, a standard compressor in which its motor is rotated at a constant speed is generally utilized together with the variable rotation number compressor. If a plurality of compressors is utilized, the entire size of an outdoor unit is enlarged and, accordingly, the handling of the outdoor unit becomes difficult.

Pulse width modulated(PWM) compressors are disclosed in, e.g., U.S. Pat. No. 6,047,557 and Japanese Unexamined Pat. Publication No. Hei 8-334094. These PWM compressors are utilized in refrigeration systems each having a plurality of freezing compartments or refrigerating compartments, and designed to be applied in short piping systems where the portion of a refrigerant conduit situated between a compressor and an evaporator is short. Consequently, these compressors cannot be directly applied to air conditioning systems for buildings that require long piping and are given control environments much different from those for the refrigeration systems. Heretofore, there has been a disclosure of a control system and method for utilizing a pulse width modulated compressor in an multi-air conditioner.

DISCLOSURE OF THE INVENTION

Accordingly, the present invention is directed to an air conditioner control system and control method thereof that substantially obviates one or more of the problems due to limitations and disadvantages of the related art.

It is an object of the present invention to provide an air conditioner control system, and control method thereof, employing a pulse-width modulated compressor, a single outdoor unit and plural indoor units relatively far from each other.

It is another object of the present invention to provide an air conditioner control system, and control method thereof, capable of calculating a required cooling capacity by computing a required cooling capacity for each respective indoor unit, and transmitting the computed cooling capacities to an outdoor unit, calculates the total required cooling capacity, and varying the capacity of the pulse-width modulated compressor in response to the calculated total cooling capacity requirement.

It is still another object of the present invention to provide an air conditioner control system having a pulse-width modulated compressor and plural evaporators, effectively designed to be suitable for air conditioning buildings.

In order to achieve the above objects, and in accordance with an aspect of the principles of the present invention, an air conditioner control system includes a compressor installed in an outdoor unit, said compressor being controlled by pulse-width modulation; a condenser connected to the compressor; a plurality of indoor units each having an evaporator, each evaporator being connected to the compressor and the condenser; indoor control units configured to calculate a respective required individual cooling capacity; and an outdoor control unit producing a duty cycle control signal in response to the required individual cooling capacities transmitted from respective one of said plurality of indoor control units, and controlling the capacity of the compressor in response to the duty cycle control signal.

According to another aspect of the present invention, an air conditioner control system includes a compressor having two states, each state corresponding to an operating capacity different from that of the other state, and configured to operate selectively in one of the two states while power is being applied thereto; a condenser connected to the compressor; one or more evaporators connected to the compressor and the condenser; a temperature sensor sensing an indoor temperature of a room being air conditioned; and a control unit configured to calculate required cooling capacity on the basis of the difference between said indoor temperature sensed by each temperature sensor and a preset temperature, said preset temperature being a desired indoor temperature for the room, and produce a duty cycle control signal based on the calculated required cooling capacity to control of the compressor to operate in one of said two states.

According to still another aspect of the present invention, an air conditioner control system includes a compressor having variable capacity and being controlled by pulse-width modulation; and a control unit configured to control variable capacity of the compressor wherein the control unit produces a duty cycle control signal which is a function of required cooling capacities transmitted from one or more indoor unit, to control the variable capacity of the compressor.

According to still another aspect of the present invention, a method of controlling an air conditioner having an outdoor unit with a pulse-width modulated compressor, and a plurality of indoor units each having an evaporator, includes: calculating required cooling capacities of the respective ones of said plurality of indoor units, under the control of the respective ones of said plurality of indoor units, transmitting the calculated required cooling capacities to the outdoor unit, adding the required cooling capacities transmitted from the respective indoor units together under the control of the outdoor unit to produce a total required cooling capacity, and producing a duty cycle control signal which is a function of the total required cooling capacity; and controlling the capacity of the compressor in response to the duty cycle control signal.

According to still another aspect of the present invention, a method of controlling an air conditioner having an outdoor unit with a pulse-width modulated compressor, and an evaporator installed in a room being air conditioned, comprising: sensing indoor temperatures of the room, finding a difference between the sensed indoor temperature and a preset temperature, said preset temperature being is a desired indoor temperature, calculating required cooling capacities on the basis of the difference, producing a duty cycle control signal as is a function of the calculated required cooling capacity, and controlling the capacity of the compressor in response to the duty cycle control signal.

Figure 1:
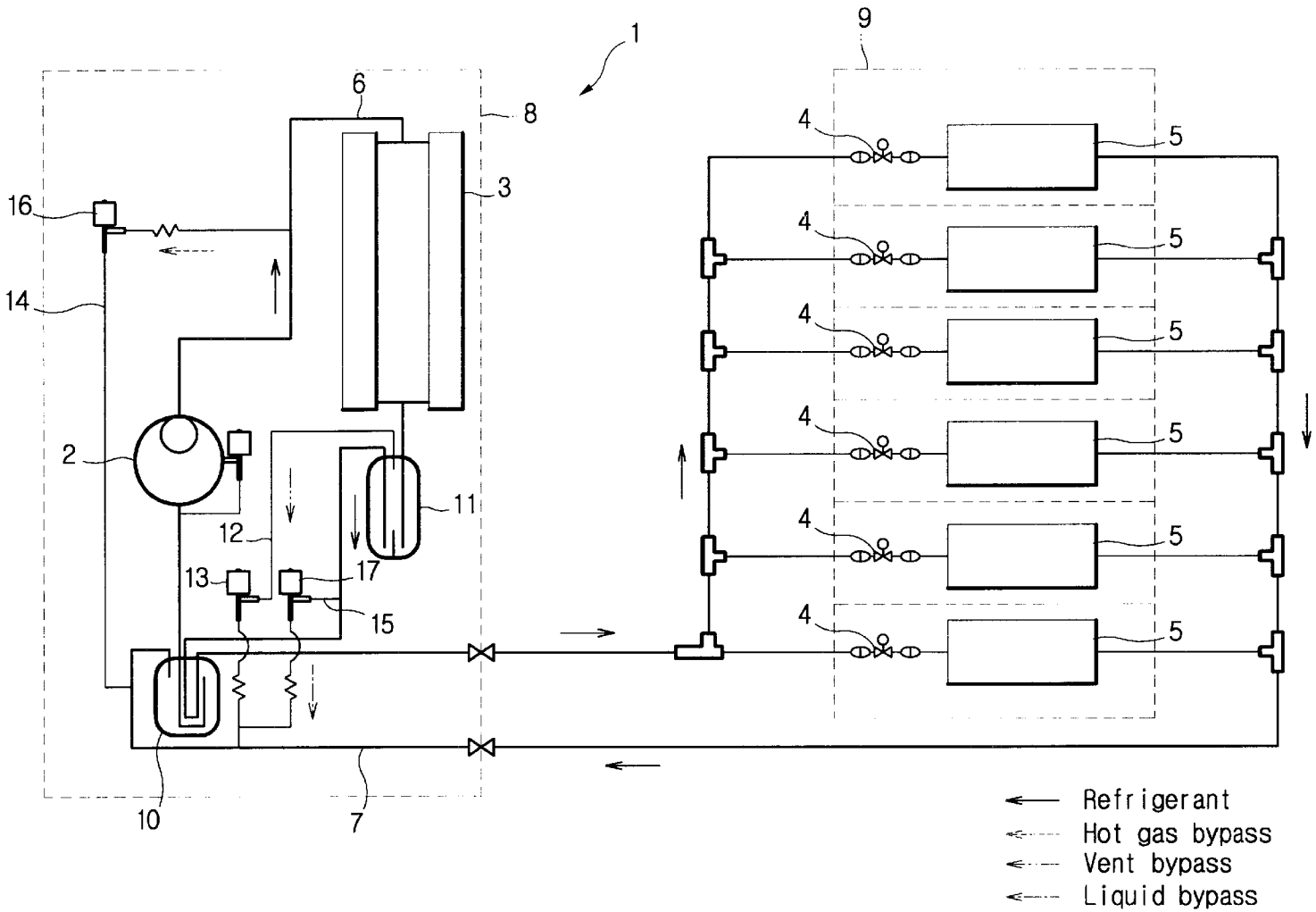
FIG. 1 shows a schematic diagram of a refrigeration cycle of an air conditioner control system according to the present invention.

*Description of reference characters of principal parts*

| | |
|---|---|
| 2: compressor | 5: evaporator |
| 8: outdoor unit | 9: indoor unit |
| 26: pulse width modulated valve | 27: outdoor control unit |
| 28: outdoor communication circuit unit | 29: indoor control unit |
| 30: temperature detecting part | |
| 31: indoor communication circuit unit | |

BEST MODE FOR CARRING OUT THE INVENTION

Exemplary embodiments according to the principles of the present invention are now described referring to the attached drawings.

FIG. 1 is a schematic diagram of a refrigeration cycle of an air conditioner control system according to the present invention.

The air conditioner 1 of the present invention includes a compressor 2, a condenser 3, a plurality of electronic expansion valves 4, and a plurality of evaporators 5, which are connected each other by refrigerant conduits to form a closed circuit. Of the refrigerant conduits, a refrigerant conduit connecting the outflow side of the compressor 2 to the inflow side of the electronic expansion valves 4 is a high pressure conduit 6 for guiding the flow of high pressure refrigerant discharged from the compressor 2, while a refrigerant conduit connecting the outflow side of the electronic expansion valves 4 to the inflow side of the compressor 2 is a low pressure conduit 7 for guiding the flow of low pressure refrigerant expanded in the electronic expansion valves 4. The condenser 3 is situated on the high pressure conduit 6, while the evaporators 5 are situated on the low pressure conduit 7. While the compressor 2 is operated, refrigerant flows in the direction shown by the solid arrow.

In addition, the air conditioner 1 of the present invention includes an outdoor unit 8 and a plurality of indoor units 9. The outdoor unit 8 includes the above described compressor 2, and condenser 3. The outdoor unit 8 further includes an accumulator 10 situated on the low pressure conduit 7 upstream of the compressor 2 and a receiver 11 situated on the high pressure conduit 6 downstream of the condenser 3. The accumulator 10 serves to collect and evaporate liquid refrigerant having not been evaporated and allow evaporated refrigerant to flow into the compressor 2. If refrigerant is not evaporated completely in the evaporators 5, refrigerant entering the accumulator 10 is a mixture of liquid refrigerant and gaseous refrigerant. The accumulator 10 evaporates liquid refrigerant, and allows only gaseous refrigerant (gas refrigerant) to enter the compressor 2. To this end, it is desirable to situate the entrance and exit ends of the refrigerant conduit in the upper portion of the accumulator 10.

If refrigerant is not condensed completely in the condenser 3, refrigerant entering the receiver 11 is a mixture of liquid refrigerant and gaseous refrigerant. The receiver 11 is constructed to separate the liquid refrigerant and the gaseous refrigerant from each other and to allow only the liquid refrigerant to be discharged. To this end, the entrance and exit ends of the refrigerant conduit situated inside of the receiver 11 are extended to the lower portion of the receiver 11.

In order to bypass gaseous refrigerant situated in the receiver 11, a vent bypass conduit 12 is provided to connect the receiver 11 to the low pressure conduit 7 upstream of the accumulator 10. The entrance end of the vent bypass conduit 12 is situated in the upper portion of the receiver 11, so only gaseous refrigerant enters the vent bypass conduit 12. A vent valve 13 is provided on the vent bypass conduit 12 and controls the flow rate of gaseous refrigerant bypassed. Double dotted arrows indicate the flow direction of the gaseous refrigerant flowing through the vent bypass conduit 12.

The portion of the high pressure conduit 6 extended from the receiver 11 is constructed to pass through the accumulator 10. This construction is to evaporate the liquid refrigerant of low temperature collected in the accumulator 10 by using the refrigerant of relatively high temperature passing through the high pressure conduit 6. In order to effectively evaporate the refrigerant, the portion of the low pressure conduit 7 situated in the accumulator 10 is formed in the shape of U, while the portion of the high pressure conduit 6 passing through the accumulator 10 is positioned to pass through the interior of the U-shaped portion of the low pressure conduit 7.

The outdoor unit 8 further includes a hot gas bypass conduit 14 connecting the portion of the high pressure conduit 6 between the compressor 2 and the condenser 3 to the accumulator 10, and a liquid bypass conduit 15 connecting the downstream side of the receiver 11 and the upstream side of the accumulator 10. A hot gas valve 16 is situated on the hot gas bypass conduit 16 to control the flow rate of hot gas bypassed, and a liquid valve 17 is situated on the liquid bypass conduit 15 to control the flow rate of liquid refrigerant bypassed. Accordingly, when the hot gas valve 16 is opened, a portion of hot gas discharged from the compressor 2 flows along the hot gas bypass conduit 14 in the direction indicated by the dotted arrow of FIG. 1; when the liquid valve 17 is opened, a portion of liquid refrigerant discharged from the receiver 11 flows along the liquid bypass conduit 15 in the directions indicated by the double dotted arrow of FIG. 1.

A plurality of indoor units 9 are arranged in parallel. Each of the indoor units 9 includes an electronic expansion valve 4 and an evaporator 5. Consequently, a plurality of indoor units 9 are connected to a single outdoor unit 8. The capacities and shapes of indoor units may be identical with or different from one another.

Figure 2A:
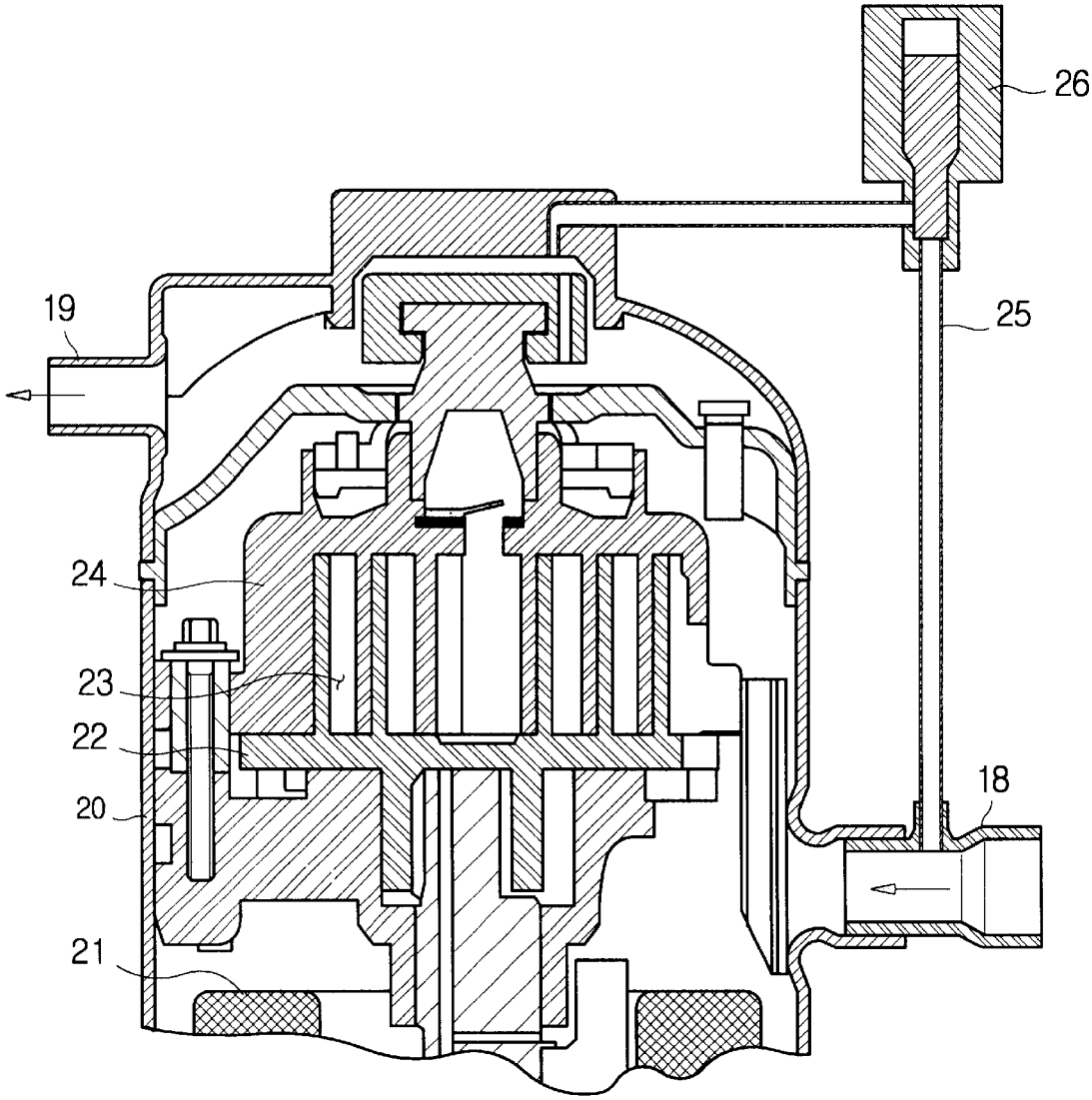
FIG. 2*a* shows a cross-sectional view of a pulse-width modulated compressor in a loading state for the inventive air conditioner.
Figure 2B:
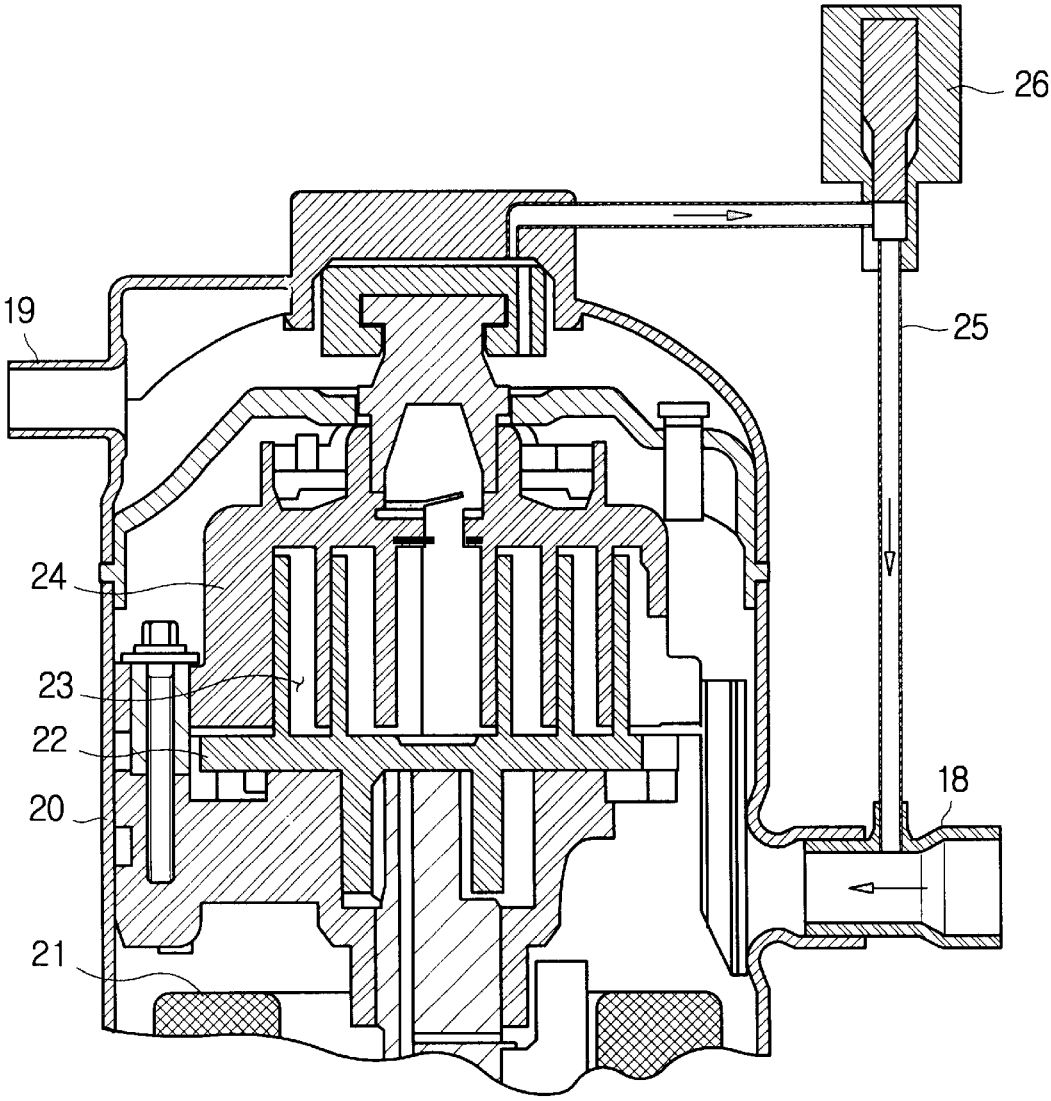
FIG. 2*b* shows a cross-sectional view of the pulse-width modulated compressor in an unloading state for the inventive air conditioner.

As depicted in FIGS. 2*a* and 2*b*, a variable capacity compressor controlled in a pulse width modulation fashion are employed as the compressor 2. The compressor 2 includes a casing 20 provided with an inlet 18 and an outlet 19, a motor 21 situated in the casing 20, a rotating scroll 22 rotated by the rotating force of the motor 21, and a stationary scroll 24 defining a compressing chamber 23 together with the rotating scroll 22. A bypass conduit 25 is attached to the casing 20 to connect a position(outlet side) over the stationary scroll 24 to the inlet 18, and a PWM(Pulse Width Modulated Valve) valve 26 in the form of a solenoid valve is mounted on the bypass conduit 25. In FIG. 2*a*, when the PWM valve 26 is OFF, the bypass conduit 25 is closed. In this state, the compressor 2 discharges refrigerant. This state is referred to as "a loading state", and in this state the compressor 2 is operated at 100% capacity. In FIG. 2*a*, when the PWM valve 26 is ON, the bypass conduit 25 is open. In this state, the compressor 2 does not discharge refrigerant. This state is referred to as "a unloading state", and in this state the compressor 2 is operated at 0% capacity. In an embodiment of the present invention, power is supplied to the compressor 2 regardless of the loading and unloading states, and the motor 21 is rotated at a constant speed. When power is not supplied to the compressor 2, the motor 21 does not rotate and the compressor 2 is not operating.

Figure 3:
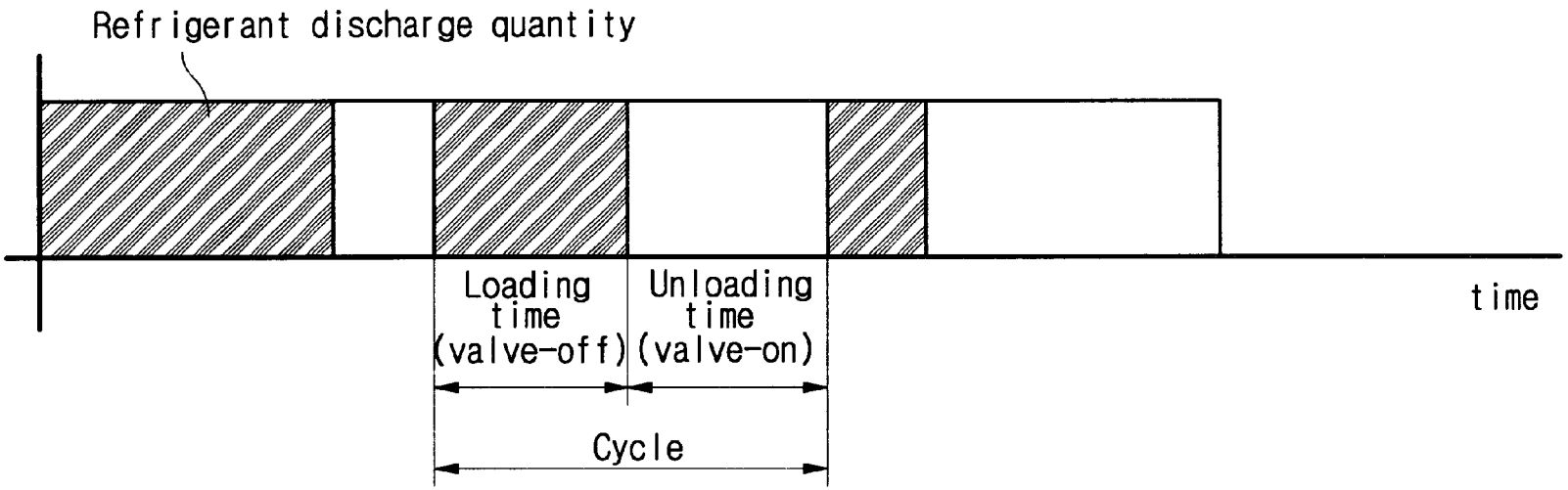
FIG. 3 depicts the relationship between the loading and unloading states and a discharge rate of a refrigerant during operation of the compressor of FIGS. 2*a* and 2*b;*

As shown in FIG. 3, the compressor 2 periodically experiences the loading and unloading states during its operation. Loading time and unloading time vary according to required cooling capacity. During the loading time the temperature of the evaporator 5 is decreased because the compressor 2 discharges refrigerant, while during the unloading time the temperature of the evaporator 5 is increased because the compressor 2 does not discharge refrigerant. In FIG. 3, the hatched portions indicate the amount of discharged refrigerant. A signal for controlling loading and unloading times is referred to as a duty control signal. In an embodiment of the present invention, the capacity of the compressor 2 is varied in such a way that the loading and unloading times are varied according to the required total cooling capacity of the compressor 2 while the period of the duty control signal is kept constant, for example, 20 seconds.

Figure 4:
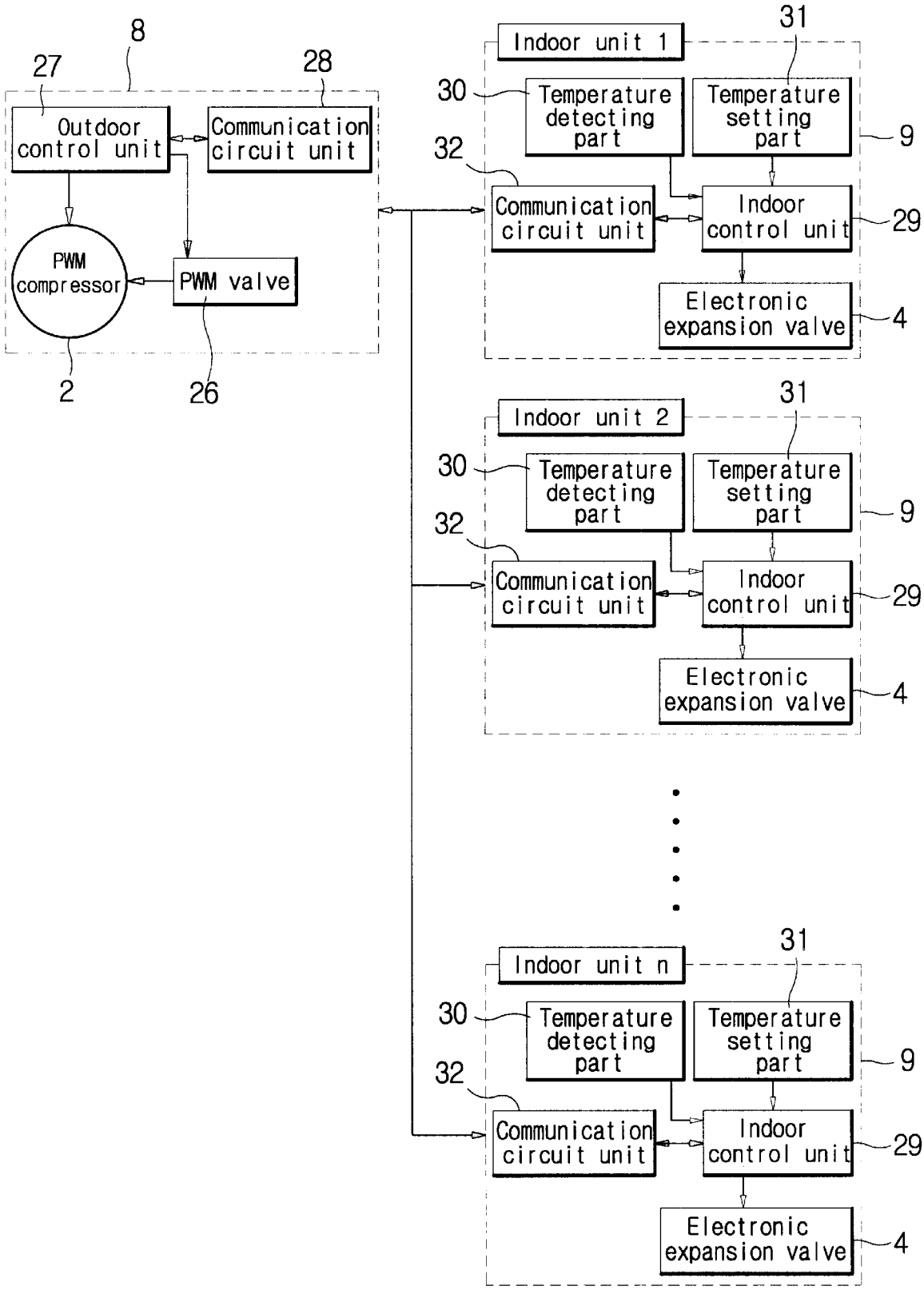
FIG. 4 is an overall block diagram of the air conditioner control system according to the present invention.

FIG. 4 is a block diagram showing the system for controlling in accordance with the present invention. As depicted in FIG. 4, the outdoor unit 8 includes an outdoor control unit 27 connected to the compressor 2 and PWM valve 26. The outdoor control unit 27 is connected to an outdoor communication circuit unit 28 to transmit and receive data. Each indoor unit 9 includes an indoor control unit 29. A temperature detecting unit 30 and a temperature setting unit 31 for indicating the designed temperature are connected to the input port of the indoor control unit 29, and the electronic expansion valve 4 is connected to the output port of the indoor control unit 29. The temperature detecting unit 30 is a temperature sensor for sensing the temperature of a room to be air-conditioned. The required cooling capacity of the room can be calculated on the basis of the temperature detected by the temperature detecting part 30. A pressure sensor for sensing a refrigerant's pressure may be used instead of the temperature sensor, and such temperature and pressure sensors are load sensors for computing a required cooling capacity of each indoor unit, i.e. load of each indoor unit.

Each indoor unit 9 includes an indoor communication circuit unit 32 connected to the indoor control unit 29 to transmit and receive data. The outdoor communication circuit unit 28 and the indoor communication circuit units 32 are constructed to transmit and receive data in a wired or wireless fashion.

The indoor control units 29 receive signals from the respective temperature detecting units 30 and temperature setting units 31 to calculate the cooling capacities required for the respective indoor units 9 on the basis of the differences between the actual temperatures and preset temperatures. Each indoor control unit 29 has the information about its own cooling capacity, and can calculate each required cooling capacity on the basis of both the difference between the actual temperature and preset temperature and its own cooling capacity, or only on the basis of the cooling capacity of the indoor unit. If the indoor control unit 29 calculates a required cooling capacity only on the basis of its cooling capacity, its cooling capacity becomes a required cooling capacity. The cooling capacity is turned into a capacity code value for application as illustrated in the below Table 1.

TABLE 1

| | Indoor unit 1 | Indoor unit 2 | Indoor unit 3 | Indoor unit 4 | Indoor unit 5 | Indoor unit 6 | All the units |
|---|---|---|---|---|---|---|---|
| Cooling capacity Kcal/hr | 6200 | 3550 | 2800 | 2800 | 1800 | 1800 | 18900 |
| Capacity code | 62 | 35 | 28 | 28 | 18 | 18 | 189 |

Table 1 shows six indoor units connected to a 7.5-horsepower compressor in which the capacity codes are set to be a multiple of each indoor unit's cooling capacity. In the case where the cooling capacities required by the respective indoor units are calculated considering both the difference between the actual indoor air temperatures and preset temperatures and their own cooling capacities, the required cooling capacities can be obtained by multiplying the capacity code of Table 1 by a compensation coefficient that is set on the basis of the difference between the actual temperature and preset temperature. The compensation coefficient Q is determined according to FIG. 5.

Figure 5:
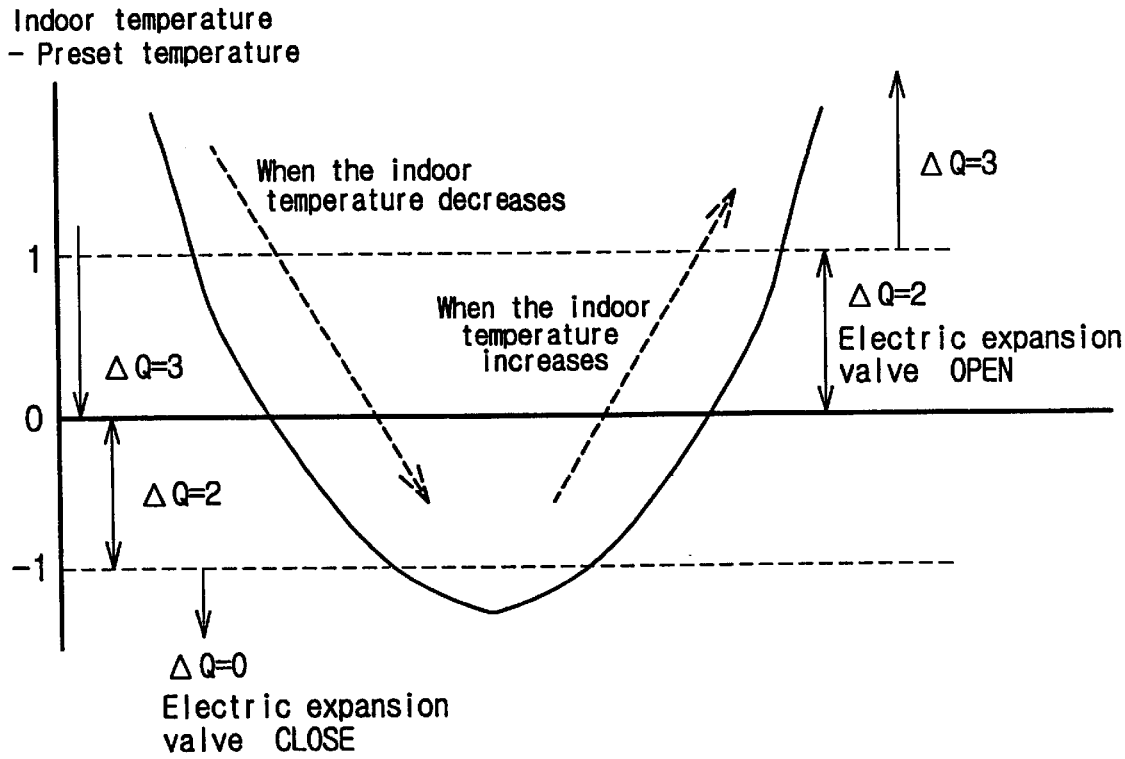
FIG. 5 graphically depicts the relationship of the difference between the actual indoor temperature and a preset temperature with a compensation coefficient used for the inventive air conditioner control system and the control method thereof.

As shown in FIG. 5, Q is set on the basis of the difference between the detected indoor temperature and the preset temperature. Even if there is no difference between them, the compensation coefficient in the case that the indoor temperature decreases becomes different from the one in the case that the indoor temperature increases. For example, if the indoor temperature is higher than the preset temperature while the indoor temperature is decreasing, Q equals 3. If the indoor temperature is lower than the preset temperature by less than 1° C., Q equals 2. If it is lower by more than 1° C., Q equals 0. In the case that Q is 0, the electronic expansion valves 5 are closed. Once the electronic expansion valves 5 are closed, the refrigerant does not flow to the indoor units 9. If the indoor temperature increases and there is no difference between the indoor temperature and the preset temperature, the electronic expansion valves 5 are open. If the indoor temperature increases further and is higher than the preset temperature by less than 1° C., Q equals 2. When the indoor temperature is higher than the preset temperature by more than 1° C., Q equals 3.

The cooling individual capacity required from the respective ones of the plurality of indoor units calculated in this manner is transmitted to the outdoor control unit 27 through the communication circuit units 28 and 32, and the outdoor control unit 27 calculates the total required cooling capacity including the cooling capacities required in the respective indoor units to control the compressor 2 and the PWM valve 26. Table 2 shows the loading time and unloading time that are set according to the total required cooling capacity in a 20-second cycle.

TABLE 2

| Loading time(sec) | Unloading Time(sec) | Total required cooling capacity | Loading time(sec) | Unloading time(sec) | Total required cooling capacity |
|---|---|---|---|---|---|
| 20 | 0 | 157.5 ↑ | 10 | 10 | 84.5–94.4 |
| 18 | 2 | 148.5–157.4 | 9 | 11 | 74.5–84.4 |
| 17 | 3 | 138.5–148.4 | 8 | 12 | 63.5–74.4 |
| 16 | 4 | 132.5–138.4 | 7 | 13 | 51.5–63.4 |
| 15 | 5 | 126.5–132.4 | 6 | 14 | 40.5–51.4 |

TABLE 2-continued

| Loading time(sec) | Unloading Time(sec) | Total required cooling capacity | Loading time(sec) | Unloading time(sec) | Total required cooling capacity |
|---|---|---|---|---|---|
| 14 | 6 | 120.5–126.4 | 5 | 15 | 28.5–40.4 |
| 13 | 7 | 114.5–120.4 | 4 | 16 | 19.5–28.4 |
| 12 | 8 | 104.5–114.4 | 3 | 17 | 10.5–19.4 |
| 11 | 9 | 94.5–104.4 | 2 | 18 | 10.4↓ |

Figure 6A:
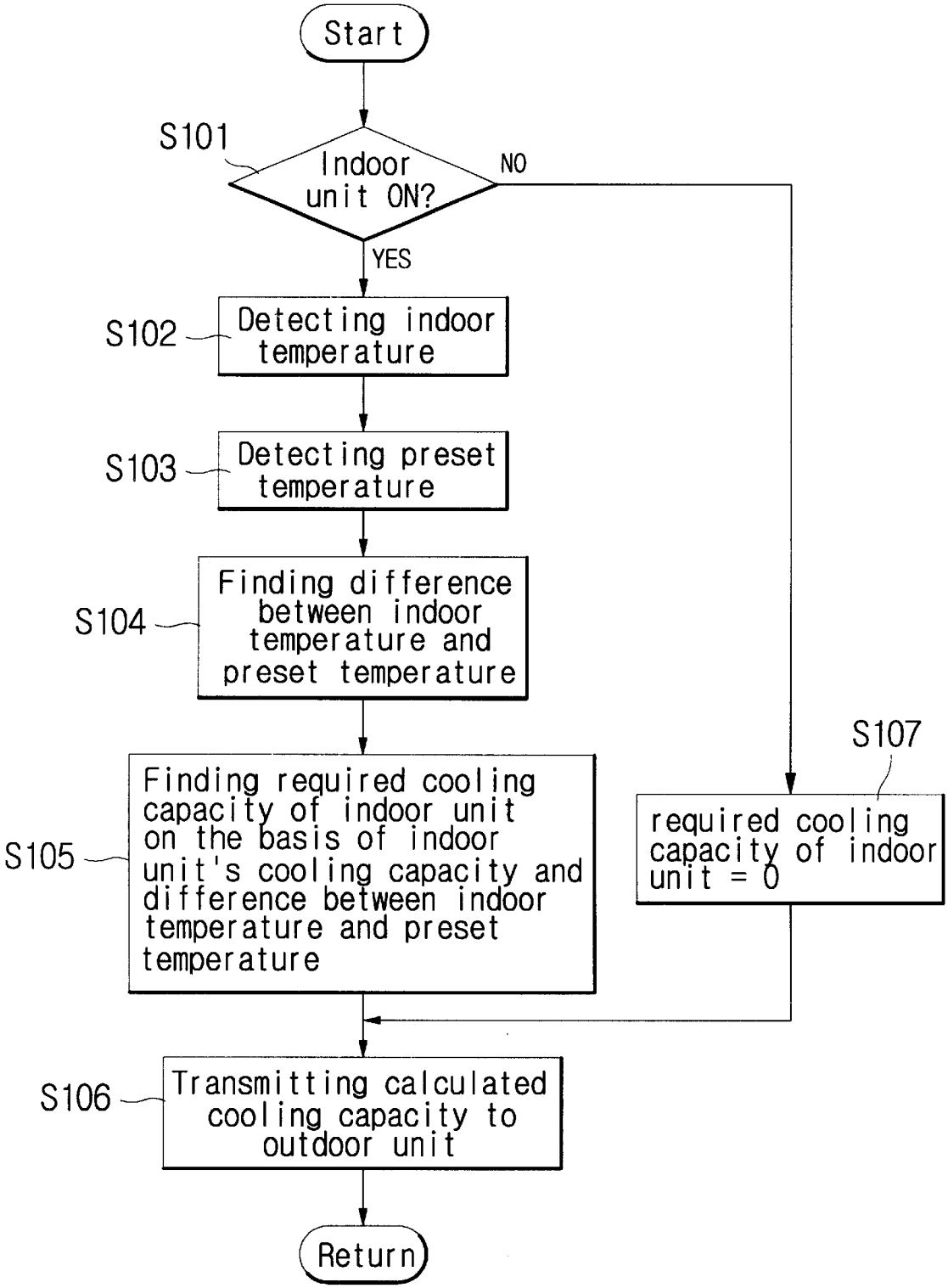
FIG. 6*a* is a flowchart diagram illustrating the control process carried out in the indoor control units of the inventive air conditioner.
Figure 6B:
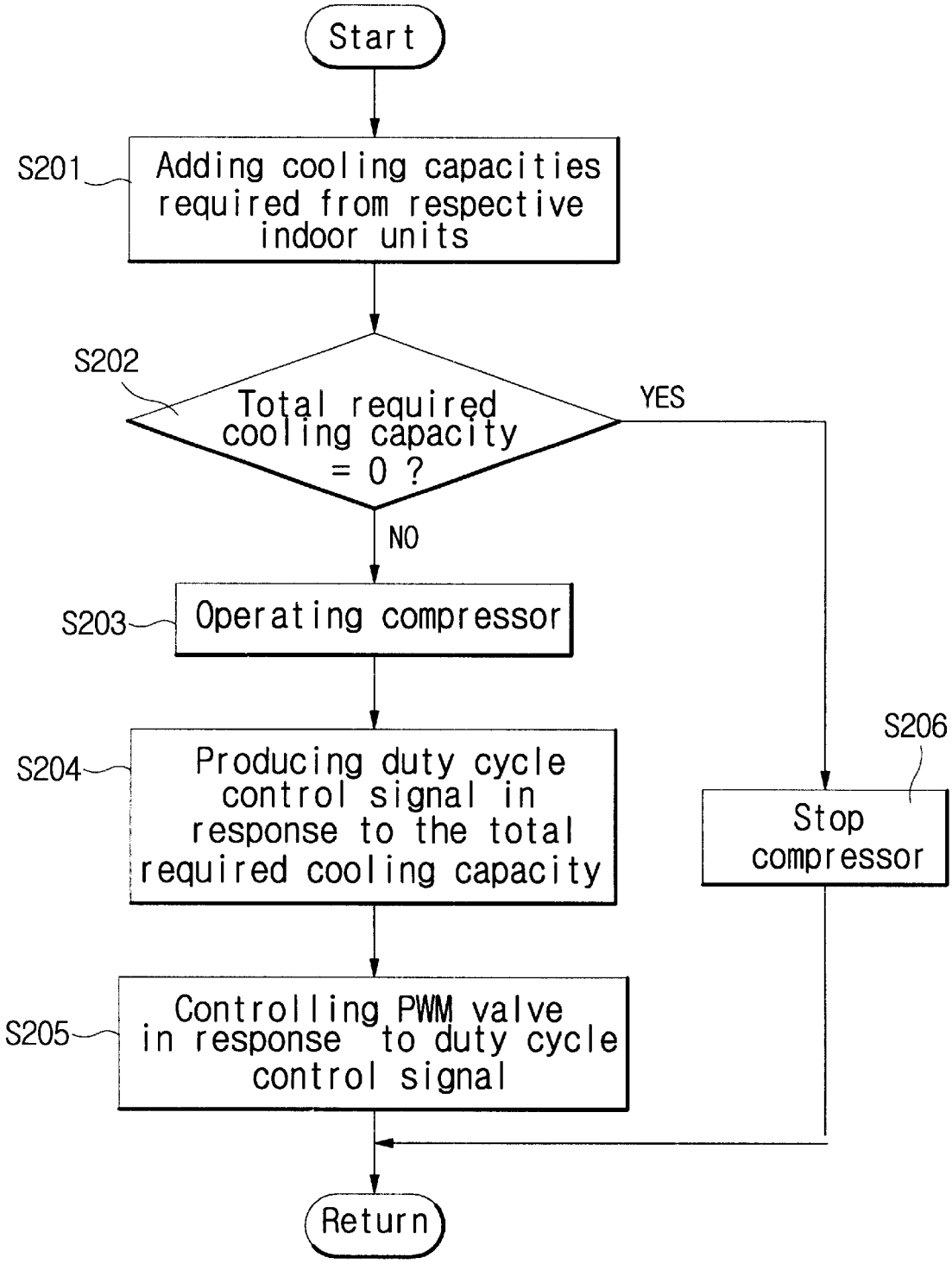
FIG. 6*b* is a flowchart diagram illustrating the control process carried out in the outdoor control unit of the inventive air conditioner.

Referring to FIGS. 6*a* and 6*b*, a method for controlling the air conditioner according to the present invention is now described.

The following description is about the control sequence in the indoor units 9 with reference to FIG. 6*a*.

The indoor control unit 29 determines if the indoor unit 9 is turned on (S101). If the indoor unit 9 is turned on, the indoor temperature is detected through the temperature detecting part 30 (S102). The indoor control unit 29 detects (S103) a preset temperature through the temperature setting part 31 to find (S104) the difference between the indoor temperature and the preset temperature. The indoor control unit 29 calculates (S105) the cooling capacity required from the indoor unit 9 on the basis of an available cooling capacity of the indoor units and the difference between the indoor temperature and the preset temperature. In this step, the cooling capacity of the indoor unit 9 is turned into the capacity code value for application, as shown in Table 1. Each cooling capacity required from each indoor unit 9 is obtained by multiplying the capacity code of Table 1 by a compensation coefficient that is set on the basis of the difference between the detected temperature and the preset temperature. The compensation coefficient Q is determined according to FIG. 5, as described above.

The required individual cooling capacity of each indoor unit calculated in the above manner is transmitted (S106) to the outdoor control unit 27 through the communication circuit units 28 and 32. If the indoor unit 9 is turned off in step S101, the required individual cooling capacity of the indoor unit 9 is 0 (S107), and this value is sent to the outdoor unit.

Referring to FIG. 6*b*, the control sequence of the outdoor unit 8 is now described. The outdoor control unit finds (S201) the total required cooling capacity by adding together each of the cooling capacity required by the respective ones of the plurality of indoor units 9. If the total required cooling capacity is 0, the outdoor control unit stops (S206) the compressor 2. If the total required cooling capacity is not 0, it operates the compressor 2. When operating the compressor 2, the outdoor control unit produces (S204) a duty cycle control signal in response to the total required cooling capacity, and controls the turned-on/off state of the PWM valve in response to the duty cycle control signal. The duty cycle control signal is a signal for determining the loading time and unloading time. Such loading time and unloading time are determined according to the total required cooling capacity, as shown in Table 2. Once the loading time and unloading time are determined, the outdoor control unit 27 controls (S205) the PWM valve in response to the duty cycle control signal.

As fully described above, according to the inventive air conditioner control system and control method thereof, large-scale cooling load capacity such as an air conditioning system with a plurality of indoor units connected to a single outdoor unit can be efficiently controlled by regulating the capacity of the air conditioner by means of the pulse-width modulated compressor. The communication circuit units are each provided to the indoor units and outdoor unit to transmit the calculated cooling capacities required from the respective indoor units to the outdoor unit, which can be efficiently applied to air conditioning for a large building having indoor/outdoor units relatively far apart from each other.

The required cooling capacity of each indoor unit is calculated in each indoor unit and transmitted to the outdoor unit, and the outdoor unit can compute the totally required cooling capacity efficiently. The capacity of the pulse-width modulated compressor can be varied effectively by using the duty cycle control signal determining the loading/unloading time previously set according to the calculated cooling capacity.

Moreover, in the inventive air conditioner control system using the pulse-width modulated compressor, even if the capacity of the compressor is varied, its motor turns at a constant speed, which is different from a variable rotation number compressor in which the turning motor is directly controlled. Thus, it provides satisfactory control response without the vibrations and noises that may be produced due to the change in the number of rotation of the motor, thereby increases the life span of the motor and compressor, and enhances the overall mechanical reliability of the system. Since there is no need to change the frequency of electric currents to the motor, the control circuit is simple in design and its power consumption is low.

It should be understood that various other modifications will be apparent to and can be readily made by those skilled in the art without departing from the scope and spirit of the invention. Accordingly, it is not intended that the scope of the claims appended hereto to be limited to the description as set forth herein, but rather that the claims be construed as encompassing all the features of patentable novelty that reside in the present invention, including all features that would be treated as equivalents thereof by those skilled in the art to which this invention pertains.

What is claimed is:

1. An air conditioner control system, comprising:

a compressor installed in an outdoor unit, said compressor being controlled by pulse-width modulation;

a condenser connected to the compressor;

a plurality of indoor units each having an evaporator, each evaporator being connected to the compressor and the condenser;

indoor control units each configured to calculate a respective required individual cooling capacity; and an outdoor control unit producing a duty cycle control signal in response to the required individual cooling capacity transmitted from respective ones of said plurality of indoor units to control a capacity of the compressor.

2. The air conditioner control system according to claim 1, wherein each of said plurality of indoor units has an indoor communication circuit unit through which the required individual cooling capacity calculated is transmitted, and the outdoor unit has an outdoor communication circuit unit configured to receive data from the indoor communication circuit unit of respective ones of said plurality of indoor units and to transmit the data to the outdoor control unit.

3. The air conditioner control system according to claim 1, wherein the outdoor control unit is configured to vary the capacity of the compressor in response to a total required cooling capacity obtained by adding together each required individual cooling capacity transmitted from the respective ones of said plurality of indoor control units.

4. The air conditioner control system according to claim 1, wherein each of said plurality of indoor units has a temperature sensor to sense an indoor air temperature, and calculates the required individual cooling capacity based on a difference between the sensed indoor temperature and a preset temperature.

5. The air conditioner control system according to claim 1, wherein each of said plurality indoor units has a temperature sensor to detect an indoor air temperature, and calculates the required individual cooling capacity based on at least one of an available cooling capacity of the respective ones of said plurality of indoor units and a difference between the detected indoor air temperature and a preset temperature.

6. The air conditioner control system according to claim 5, wherein the required individual cooling capacity is a value obtained by multiplying a capacity code by a compensation coefficient that is set based on the difference between the detected indoor temperature and the preset temperature, said capacity code being a number multiple of said available cooling capacity of a respective one of said plurality of indoor units.

7. The air conditioner control system according to claim 6, wherein the compensation coefficient becomes a lower value when the indoor temperature increases than when the indoor temperature decreases.

8. The air conditioner control system according to claim 1, wherein the capacity of the compressor is either one of 100% capacity or 0% capacity.

9. The air conditioner control system according to claim 1, wherein the plurality of indoor units are arranged in parallel with respect to each other.

10. The air conditioner control system according to claim 1, wherein the outdoor unit includes an accumulator provided to a low-pressure conduit upstream of the compressor, and a receiver provided to a high-pressure conduit downstream of the condenser.

11. The air conditioner control system according to claim 10, wherein the outdoor unit further includes a vent bypass conduit connecting said receiver to the low-pressure conduit upstream of said accumulator, said vent bypass conduit having thereon a vent valve.

12. The air conditioner control system according to claim 11, wherein a portion of the low-pressure conduit within the accumulator is formed as a U-shaped portion, and the high-pressure conduit that comes out of the receiver and passes through the accumulator is disposed so as to pass through an interior of the U-shaped portion of the low-pressure conduit.

13. The air conditioner control system according to claim 10, wherein the outdoor unit further includes a hot gas bypass conduit connecting a portion of the high-pressure conduit between the compressor and the condenser to the accumulator, and said hot gas bypass conduit having thereon a hot gas valve.

14. The air conditioner control system according to claim 10, wherein the outdoor unit further includes a liquid bypass conduit connected downstream of the receiver and upstream of the accumulator, and a liquid valve provided halfway along the liquid bypass conduit.

15. An air conditioner control system, comprising:

a compressor having two states, each state corresponding to an operating capacity different from that of the other state, to operate selectively in one of the two states while power is being applied thereto;

a condenser connected to the compressor;

one or more evaporators connected to the compressor and the condenser;

a temperature sensor sensing an indoor temperature of a room being air conditioned; and a control unit to calculate a required cooling capacity which is a value obtained by multiplying a capacity code by a compensation coefficient, the compensation coefficient being set based on a difference between said indoor temperature sensed by the temperature sensor and a preset temperature, said preset temperature being a desired indoor temperature for the room, and to produce a duty cycle control signal based on the calculated required cooling capacity to control the compressor operating in one of said two states.

16. The air conditioner control system according to claim 15, wherein the operating capacities of the compressor in the two states are 100% and 0%, respectively.

17. The air conditioner control system according to claim 15, wherein the control unit calculates a required cooling capacity according to an available cooling capacity of the one or more evaporators.

18. The air conditioner control system according to claim 15, wherein the one or more evaporators are arranged in parallel with respect to each other.

19. An air conditioner control system comprising a compressor having a variable capacity and being controlled by pulse-width modulation; and a control unit configured to control the variable capacity of the compressor, said control unit producing a duty cycle control signal which is a function of required cooling capacities transmitted from one or more indoor units to control the variable capacity of the compressor.

20. The air conditioner control system according to claim 19, wherein the duty cycle control signal prescribes a loading time to discharge a refrigerant from the compressor and an unloading time not to discharge the refrigerant from the compressor.

21. The air conditioner control system according to claim 20, wherein the variable capacity of the compressor is 100% during the loading time, and the variable capacity of the compressor is 0% during the unloading time.

22. A method of controlling an air conditioner having an outdoor unit with a pulse-width modulated compressor, and a plurality of indoor units each having an evaporator, comprising:

calculating required cooling capacities of respective ones of said plurality of indoor units, under a control of the respective ones of said plurality of indoor units;

transmitting the calculated required cooling capacities to the outdoor unit;

adding the cooling capacities transmitted from respective indoor units together under a control of the outdoor unit to produce a total required cooling capacity;

producing a duty cycle control signal which is a function of said total required cooling capacity; and controlling a capacity of the compressor in response to the duty cycle control signal.

23. The method of controlling an air conditioner according to claim 22, wherein the calculating of the required cooling capacities comprises:

calculating the required cooling capacity of each of said plurality of indoor units calculated based on the cooling capacity of a respective one of said plurality of indoor units.

24. The method of controlling an air conditioner according to claim 22, wherein the required cooling capacity of each of said plurality of indoor units is calculated based on the cooling capacity of the respective one of said plurality of indoor units and a difference between an actual indoor temperature and a preset temperature.

25. The method of controlling an air conditioner according to claim 24, wherein the required cooling capacity of each of said plurality of indoor units is a value obtained by multiplying a capacity code by a compensation coefficient that is set based on the difference between the actual indoor temperature and the preset temperature, said capacity code being a number multiple of and an available cooling capacity of a respective one of said plurality of indoor units.

26. The method of controlling an air conditioner according to claim 25, wherein the compensation coefficient is a lower value when the actual indoor temperature increases than when the actual indoor temperature decreases.

27. The method of controlling an air conditioner according to claim 22, wherein the calculated required cooling capacity of each of said plurality of indoor units is transmitted from a communication circuit unit of the respective one of said plurality of indoor units to a communication circuit unit of the outdoor unit.

28. The method of controlling an air conditioner according to claim 22, wherein the duty cycle control signal prescribes a loading time to discharge a refrigerant from the compressor and an unloading time not to discharge the refrigerant from of the compressor.

29. The method of controlling an air conditioner according to claim 28, wherein the capacity of the compressor is 100% during the loading time, and the capacity of the compressor is 0% during the unloading time.

30. A method of controlling an air conditioner having an outdoor unit with a pulse-width modulated compressor, and an evaporator installed in a room being air conditioned, comprising:

sensing an indoor temperature of the room being air conditioned;

finding a difference between the sensed indoor temperature and a preset temperature, said preset temperature being a desired indoor temperature of the room;

calculating a required cooling capacity which is a value obtained by multiplying a capacity code by a compensation coefficient, the compensation coefficient being set based on the difference;

producing a duty cycle control signal as a function of the calculated required cooling capacity; and controlling a capacity of the compressor in response to the duty cycle control signal.

31. The method of controlling an air conditioner according to claim 30, wherein the calculating of the required cooling capacity comprises:

calculating the required cooling capacity of the room obtained by multiplying the capacity code value by the compensation coefficient that is set based on the difference between the sensed indoor temperature and the preset temperature, said capacity code value being a number multiple of an available capacity of the evaporator.

32. The method of controlling an air conditioner according to claim 31, wherein the compensation coefficient is a lower value when the indoor temperature increases than when the indoor temperature decreases.

33. An air conditioner control system, comprising:

a compressor disposed in an outdoor unit;

a condenser connected to the compressor;

a plurality of indoor units each having an evaporator and an indoor control unit, each evaporator being connected to the compressor and the condenser, each indoor control unit calculating a required individual cooling capacity; and an outdoor control unit producing a signal in response to the required individual cooling capacity transmitted from the plurality of indoor units to control a capacity of the compressor.

34. The air conditioner control system according to claim 33, wherein:

each of the plurality of indoor units comprises:

an indoor communication unit transmitting the required individual cooling capacity; and the outdoor unit comprises:

an outdoor communication unit receiving the required individual cooling capacity from the indoor communication unit.

35. The air conditioner control system according to claim 33, wherein the outdoor control unit varies the capacity of the compressor according to a total required cooling capacity obtained by summing each required individual cooling capacity.

36. The air conditioner control system according to claim 33, wherein each of said plurality indoor units comprises:

a temperature sensor to detect an indoor air temperature and to calculate the required individual cooling capacity based on one or more available cooling capacities of the plurality of indoor units and a difference between the detected indoor air temperature and a preset temperature.

37. The air conditioner control system according to claim 36, wherein the required individual cooling capacity is based on a value obtained by multiplying a capacity code by a compensation coefficient, the compensation coefficient being based on the difference between the detected indoor temperature and the preset temperature, the capacity code being a number multiple of the available cooling capacity of a respective one of said plurality of indoor units.

38. The air conditioner control system according to claim 37, wherein the compensation coefficient is based on a direction of a change in indoor temperature.

39. The air conditioner control system according to claim 33, wherein a capacity of the compressor is one of a 100% capacity and a 0% capacity.

40. The air conditioner control system according to claim 33, wherein the plurality of indoor units are arranged in parallel with respect to each other.

41. The air conditioner control system according to claim 33, wherein the outdoor unit comprises:

an accumulator connected to a low-pressure conduit upstream of the compressor; and a receiver connected to a high-pressure conduit downstream of the condenser.

42. The air conditioner control system according to claim 41, wherein the outdoor unit further comprises:

a vent valve; and a vent bypass conduit connecting the receiver to the low-pressure conduit upstream of the accumulator, the vent bypass conduit having thereon the vent valve.

43. The air conditioner control system according to claim 42, wherein the low-pressure conduit comprises:

a U-shaped portion within the accumulator, the high-pressure conduit connected to the receiver and passes through the accumulator so as to pass through the U-shaped portion of the low-pressure conduit.

44. The air conditioner control system according to claim 41, wherein the outdoor unit further comprises:

a hot gas valve;

a hot gas bypass conduit connecting the high-pressure conduit between the compressor and the condenser to the accumulator, and having thereon the hot gas valve;

a liquid bypass conduit connecting downstream of the receiver to upstream of the accumulator; and a liquid valve provided along the liquid bypass conduit.

45. The air conditioner control system according to claim 33, wherein the plurality of indoor units have different respective capacities.

46. An air conditioner control system comprising:

a variable capacity compressor; and a control unit to control the variable capacity compressor, and producing a duty cycle control signal which is a function of required cooling capacities transmitted from one or more indoor units to control the variable capacity compressor.

47. The air conditioner control system according to claim 46, wherein the variable capacity compressor is controlled by pulse width modulation.

48. The air conditioner control system according to claim 46, wherein the duty cycle control signal sets a loading time when variable capacity compressor is at a 100% capacity and an unloading time when the variable capacity compressor is at a 0% capacity.

49. A method of controlling an air conditioner having an outdoor unit with a compressor, and a plurality of indoor units each having an evaporator, comprising:

calculating required cooling capacities of respective ones of the plurality of indoor units at the respective ones of the plurality of indoor units;

transmitting the calculated required cooling capacities to the outdoor unit;

summing the required cooling capacities to produce a total required cooling capacity;

producing a duty cycle control signal which is a function of the total required cooling capacity; and controlling a capacity of the compressor in response to the duty cycle control signal.

50. The method of controlling an air conditioner according to claim 49, wherein the calculating of the required cooling capacities comprises:

calculating the required cooling capacity of each of said plurality of indoor units based on the cooling capacity of a respective one of the plurality of indoor units.

51. The method of controlling an air conditioner according to claim 49, wherein the required cooling capacity of each of said plurality of indoor units is calculated based on the cooling capacity of a respective one of said plurality of indoor units and a difference between an actual indoor temperature and a preset temperature.

52. The method of controlling an air conditioner according to claim 49, wherein the calculating of the required cooling capacities comprises:

calculating the required cooling capacity of each of said plurality of indoor units by multiplying a capacity code by a compensation coefficient, the compensation coefficient being based on a difference between an indoor temperature and a preset temperature, the capacity code being a number multiple of and an available cooling capacity of a respective one of the plurality of indoor units.

53. The method of controlling an air conditioner according to claim 52, wherein the compensation coefficient is a lower value when the indoor temperature increases than when the indoor temperature decreases.

54. The method of controlling an air conditioner according to claim 49, wherein transmitting the calculated required cooling capacities comprises:

transmitting the calculated required cooling capacity of each of the plurality of indoor units from a communication unit of a respective one of the plurality of indoor units to a communication unit of the outdoor unit.

55. The method of controlling an air conditioner according to claim 49, wherein producing a duty cycle control signal comprises:

setting a loading time when the compressor is at 100% capacity and an unloading time when the compressor is at 0% capacity; and providing the duty cycle control signal based on the setting.

56. An air conditioner system having an outdoor unit and a plurality of indoor units, comprising:

a compressor disposed in an outdoor unit;

an evaporator and an indoor control unit for each of the plurality of indoor units, the evaporator being connected to the compressor, and each indoor control unit calculates a required individual cooling capacity; and an outdoor control unit producing a signal according to the required individual cooling capacity transmitted from each the plurality of indoor control units to control the compressor.

57. A method of controlling an air conditioner having an outdoor unit with a pulse-width modulated compressor, and an evaporator installed in a room being air conditioned, comprising:

sensing an indoor temperature of the room for air conditioning;

finding a difference between the sensed indoor temperature and a preset temperature, said preset temperature being a desired indoor temperature of the room;

calculating a required cooling capacity based on the difference;

producing a duty cycle control signal as a function of the calculated required cooling capacity; and controlling a capacity of the compressor in response to the duty cycle control signal, wherein the calculating of the required cooling capacity comprises:

calculating the required cooling capacity of the room obtained by multiplying a capacity code value by a compensation coefficient that is set based on the difference between the sensed indoor temperature and the preset temperature, said capacity code value being a number multiple of an available capacity of the evaporator.

58. The method of controlling an air conditioner according to claim 57, wherein the compensation coefficient becomes lower value when the indoor temperature increases than when the indoor temperature decreases.

* * * * *